US006342028B1

(12) United States Patent
de Sane

(10) Patent No.: US 6,342,028 B1
(45) Date of Patent: Jan. 29, 2002

(54) MAGNETIC COUNTER FOR EXERCISE EQUIPMENT

(76) Inventor: Joseph R de Sane, P.O. Box 335, Southampton, NY (US) 11969

( * ) Notice: Subject to any disclaimer, the term of this patent is extended or adjusted under 35 U.S.C. 154(b) by 0 days.

(21) Appl. No.: 09/374,836

(22) Filed: Aug. 14, 1999

(51) Int. Cl.[7] ..... A63B 21/06

(52) U.S. Cl. ..... 482/1; 482/100; 73/379.01; 73/379.08

(58) Field of Search ..... 482/98, 106, 101, 482/102, 8, 909, 1; 104/104, 103; 73/379.01, 379.05, 379.02, 379.08

(56) References Cited

U.S. PATENT DOCUMENTS 3,647,209 A * 3/1972 La lanne ..... 482/102
4,502,680 A 3/1985 Blum et al.
4,563,003 A * 1/1986 Bugallo et al. ..... 482/8
4,934,690 A 6/1990 Bull
5,658,227 A * 8/1997 Stearns ..... 482/96
5,830,107 A 11/1998 Brigliadoro

* cited by examiner

*Primary Examiner*—Jerome Donnelly
(74) *Attorney, Agent, or Firm*—Michael I Kroll

(57) ABSTRACT

The present invention 10 discloses a device for counting the repetitions of various types of exercise machines 12. A permanent magnet 14 is attached to a movable member, e.g., a weight stack 16, of the exercise machine 12 selected so as to move within an acceptable distance of a magnetic sensor 18 positioned on a stationary member 20 of the exercise machine 12. The sensor 18 has means 28 having a power supply 34 for detecting the magnetic field 26 and displaying the repetition number on a visual display means 22. A reset button 30 is provided along with an alternative embodiment providing a timed reset 38. Also, an embodiment is described wherein a voice synthesizer 42 announces the number of the repetition in addition to having a display 22.

14 Claims, 9 Drawing Sheets

MAGNETIC COUNTER FOR EXERCISE EQUIPMENT

BACKGROUND OF THE INVENTION

1. Field of the Invention

The present invention relates generally to exercise equipment and, more specifically, to a magnetic sensor display device which can be manufactured with or attached to various exercise devices such as lat machines, chest press machines, deltoid machines, bicep curl machines, row machines, pullover machines, chin and dip machines, 45 degree row machines, squat machines, leg curl and extension machines, ab and back machines, shoulder press, and tricep pushdown, etc.

The magnetic sensor display device comprises a magnetic sensor display member mounted within or to a surface and an opposing permanent magnet mounted within or to a surface which travels within close proximity to the magnetic sensor thereby the magnetic sensor display member having means for sensing the passage of the permanent magnet and having means for displaying said passage will incrementally display the number of complete cycles of repetitious passages of said magnet. Further said magnetic sensor display member has external means for resetting the incremental display to zero and internal means for automatically resetting said display to zero based upon some selective passage of time.

Further the magnetic sensor display member can have circuitry incorporating a voice synthesizer and amplifier for sounding out the number of repetitions performed. In addition an alternate embodiment is provided wherein the magnetic sensor display member which is contained within a housing having means for attachment can be attached to existing exercise equipment and a permanent magnet can be additionally attached to some proximal passing member on said existing exercise equipment whereby the display member will incrementally record and display the number of complete cycle passages of the permanent magnet as performed in the preferred embodiment.

2. Description of the Prior Art

There are other weight exercise machines with counters. Typical of these is U.S. Pat. No. 3,647,209 issued to La Lanne on Mar. 7, 1972

Another patent was issued to Blum et al. on Mar. 5, 1985 as U.S. Pat. No. 4,502,680. Yet another U.S. Pat. No. 4,934,690 was issued to Bull on Jun. 19, 1990 and still yet another was issued on Nov. 3, 1998 to Brigliadoro as U.S. Pat. No. 5,830,107.

U.S. Pat. No. 3,647,209

Inventor: Jack La Lanne

Issued: Mar. 7, 1972

An exercising devise for lifting weights with a cable that is supported by and guided over an upright frame. A vertically movable carriage engages an upright post of the frame, means for guiding the cable to position its free end at different elevations above ground, and a locking pin mounted to the carriage for horizontal axial movement of the pin into engagement with any one of a plurality of vertically spaced apertures in the vertical post. Means are provided for biasing the pin into an aperture-engaging position, for withdrawing it therefrom, and for locking it in its aperture-engaging position. The carriage includes apertured ears for positioning an upwardly extending balanced bar resting on the ground. The end of the cable remote from the carriage has a weight connecting member that extends through central apertures in a plurality of vertically spaced weight plates that include vertically arranged, radially outwardly extending cutouts and suitable undercuts so that an angular displacement of the member about its axis through $90_{13}$ engages a protrusion projecting from the member with one of the weight plates for movement of the weight plate, together with the plates above it, with the cable. Means are provided for locking the weight connecting member in its weight plate engaging position. The member includes markings indicating the weight connected thereto. The cable is guided through and engaged by an indicating mechanism, which signals the number of times the cable and the weights suspended therefrom have been lifted.

U.S. Pat. No. 4,502,680

Inventor: Alvin S. Blum et al.

Issued: Mar. 5, 1985

An improved foot exercising device having pedals pivotally secured to a support. Leg exercise can be obtained by regularly pumping pedals up and down. A control system registers number of pumping motions and signals user when an inadequate number of motions has been registered in a particular time period. A control regulates the amplitude of motion to ensure adequate contraction and relaxation of the leg muscles. The combination satisfies the physiological requirements to prevent dependent edema in seated users. A wheelchair application is disclosed.

U.S. Pat. No. 4,934,690

Inventor: John W. Bull

Issued: Jun. 19, 1990

A shock-free exercise machine, which can be used by the young and elderly, the small and large structure person, and the inexperienced and experienced exerciser for both aerobic and anaerobic exercise, that provides a rhythmic fluid motion to the body of the user and particularly to the legs, pelvis and spine which is completely free of shock and impact stress on the joints, bones and muscle in which, at all times, the user remains in an upright standing position. In one embodiment the exercise simulates climbing motion of the user's leg with synchronized push-pull motion of the user's arms. On one embodiment the exercising machine comprises a base member; a vertical frame member fixedly attached there, right and left lower levers pivotally mounted on the lower part of the vertical member, the free ends the levers for standing on; right and left upper levers pivotally mounted on the upper part of the vertical member, right and left tie rods pivotally mounted at the upper distal ends thereof to the right and left upper levers, respectively, and pivotally mounted at the lower distal ends thereof to the right and left lower levers, respectively; rocker arm assembly for synchronizing the movement of the lower levers so that when one lower lever moves downwardly the other one moves upwardly; and shock free resistance system for resisting the movement of at least one of the levers.

U.S. Pat. No. 5,830,107

Inventor: George R. Brigliadoro

Issued: Nov. 3, 1998

An exercise machine providing selectively variable rhythmic audible accompaniment for torso twisting and arm thrusting motions. The machine has three rotatably mounted foot platforms and two upwardly projecting, pivotable hand levers. Two of the three foot platforms are located proximate to and equidistant from the hand levers and the remaining foot platform is located distally from the hand levers. The hand levers are adjustable as to resistance to pivoting, and alternatively may be fixed in place if arm motions are not desired. A music synthesizer controls tempo of exercises. Tempo, beat, volume, and other characteristics of the music may be controlled by the user. A microprocessor sums the number and frequency of body motions and calculates energy expended while exercising. This information is transmitted to a display visible to the user.

While these weight machines with counters may be suitable for the purposes for which they were designed, they would not be as suitable for the purposes of the present invention, as hereinafter described.

SUMMARY OF THE PRESENT INVENTION

The present invention discloses a device for counting the repetitions of various types of exercise machines. A permanent magnet is attached to a movable member, e.g., a weight stack, of the exercise machine selected so as to move within an acceptable distance of a magnetic sensor positioned on a stationary member of the exercise machine. The sensor has means having a power supply for detecting the magnetic field and displaying the repetition number on a visual display means. A reset button is provided along with an alternative embodiment providing a timed reset. Also, an embodiment is described wherein a voice synthesizer announces the number of the repetition in addition to displaying it.

A primary object of the present invention is to provide a device for displaying the number of repetitions of any particular exercise performed.

Another object of the present invention is to provide an exercise machine having a magnet attached to a moving portion of an exercise machine.

Yet another object of the present invention is to provide an exercise machine having a magnetic sensor which senses changes in a magnetic field.

Still yet another object of the present invention is to provide an exercise machine having a magnetic sensor which senses changes in a magnetic field and incrementally displays the number of complete cycles of said change.

Yet another object of the present invention is to provide an alternate embodiment which can be mounted to an existing exercising machine which will display the number of repetitions of a particular exercise.

Additional objects of the present invention will appear as the description proceeds.

The present invention overcomes the shortcomings of the prior art by providing a device comprising a magnetic sensor display member mounted within or to a surface and an opposing permanent magnet mounted within or to a surface which travels within close proximity to the magnetic sensor thereby the magnetic sensor display member having means for sensing the passage of the permanent magnet and having means for displaying said passage will incrementally display the number of complete cycles of repetitious passages of said magnet. Further said magnetic sensor display member has external means for resetting the incremental display to zero and internal means for automatically resetting said display to zero based upon some selective passage of time. Further the magnetic sensor display member can have circuitry incorporating a voice synthesizer and amplifier for sounding out the number of repetitions performed.

In addition an alternate embodiment is provided wherein the magnetic sensor display member which is contained within a housing having means for attachment can be attached to existing exercise equipment and a permanent magnet can be additionally attached to some proximal passing member on said existing exercise equipment whereby the display member will incrementally record and display the number of complete cycle passages of the permanent magnet as performed in the preferred embodiment.

The foregoing and other objects and advantages will appear from the description to follow. In the description reference is made to the accompanying drawings, which Form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which:

FIG. 1 is a front elevation view of the present invention being an integral component of an exercise machine. Shown is a permanent magnet attached to the top of the weight stack. Also shown is a stationary magnetic sensor contained within the proximate vertical member. The magnetic sensor having means for sensing changes to a magnetic field and having means for recording and displaying said changes caused by the passage of the permanent magnet will incrementally increase a counter each time the permanent magnet attached to the weight stack completes one cycle;

FIG. 1A is a front elevation of another type of exercise equipment wherein the present invention is an integral component of the exercise machine. Shown is a permanent magnet attached to the top of the weight stack. Also shown is a stationary magnetic sensor contained within the proximate vertical member. The magnetic sensor having means for sensing changes to a magnetic field and having means for recording and displaying said changes caused by the passage of the permanent magnet will incrementally increase a counter each time the permanent magnet attached to the weight stack completes one cycle;

FIG. 2 is an enlarged view of the magnetic counter device of the present invention. Shown is a permanent magnet contained within and forming an integral part of a member of the weight stack and a static magnetic sensor member which is located in the proximal vertical member of the exercise machine. The magnetic sensor having means for detecting changes in magnetic flux generates a voltage which initiates the beginning of a cycle when the first permanent magnet passes the magnetic sensor a first time.

FIG. 3 is an enlarged view of the magnetic counter device of the present invention. Shown is a permanent magnet contained within the weight stack and a magnetic sensor member which is located in the proximal vertical member of the exercise machine. The magnetic sensor having means for detecting changes in magnetic flux generates a voltage a second time thereby completing one cycle of the permanent magnet whereupon said display member will be incremented by one.

FIG. 4 is another enlarged view of the magnetic counter device of the present invention. Shown is a permanent magnet contained within the weight stack and a magnetic sensor member which is located in the proximal vertical member of the exercise machine. The magnetic sensor having means for detecting changes in magnetic flux generates a voltage which is transmitted to a counter which increments the display by one. Thereby completing one cycle. Also shown is a reset button which can be selectively used to reset the counter to zero.

FIG. 5 is a front elevation of an alternate embodiment of the present invention. Shown is a magnetic counter having a permanent magnet which is attached to the weight stack and a magnetic sensor member selectively attached to a proximate vertical member. The magnetic sensor having means for sensing changes caused by the permanent magnet will incrementally increase a counter each time the magnet attached to the weight stack completes one cycle. The magnetic sensor is attached to an extendable retractable rod which enables the additional embodiment to work over greater distances. Also shown is a reset button for selectively resetting the display counter to zero.

LIST OF REFERENCE NUMERALS

Figure 1:
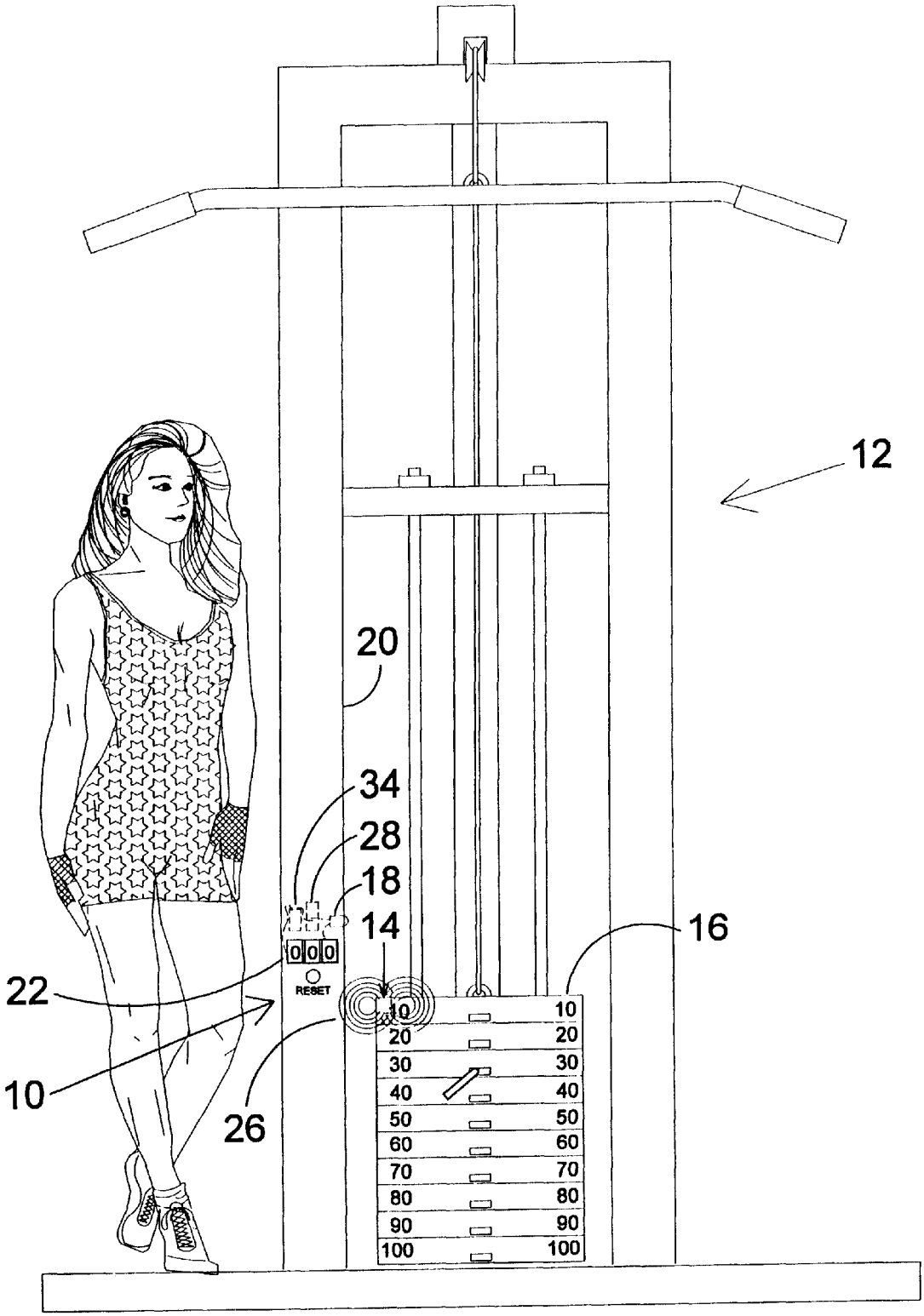

With regard to reference numerals used, the following numbering is used throughout the drawings.

10 present invention
12 exercise machine
14 permanent magnet
16 weight stack
18 magnetic sensor
20 vertical member
22 display
24 vertical member
26 flux lines
28 means for detecting
30 reset button
32 extendable rod
34 power supply
36 second reset
38 electrical connecting means
40 direction arrow
42 voice synthesizer
44 speaker

DESCRIPTION OF THE PREFERRED EMBODIMENT(S)

In order that the invention may be more fully understood it will now be described, by way of example, with reference to the accompanying drawings in which FIGS. 1 through 8 illustrate the present invention being a magnetic repetition counter for exercise equipment.

Turning to FIG. 1, shown therein is a front elevation of the present invention 10 being an integral component of an exercise machine 12. Shown is a permanent magnet 14 attached to the top of the weight stack 16. Also shown is a stationary magnetic sensor 18 contained within the proximate vertical member 20. The magnetic sensor 18 having means 28 for sensing changes to a magnetic field 26 and having means for recording and displaying 22 the changes caused by the passage of the permanent magnet 14 so as to incrementally increase a counter 22 each time the permanent magnet 14 attached to the weight stack 16 completes one cycle. An electrical power supply 34, e.g., batteries, is also shown for means 28.

Figure 1A:
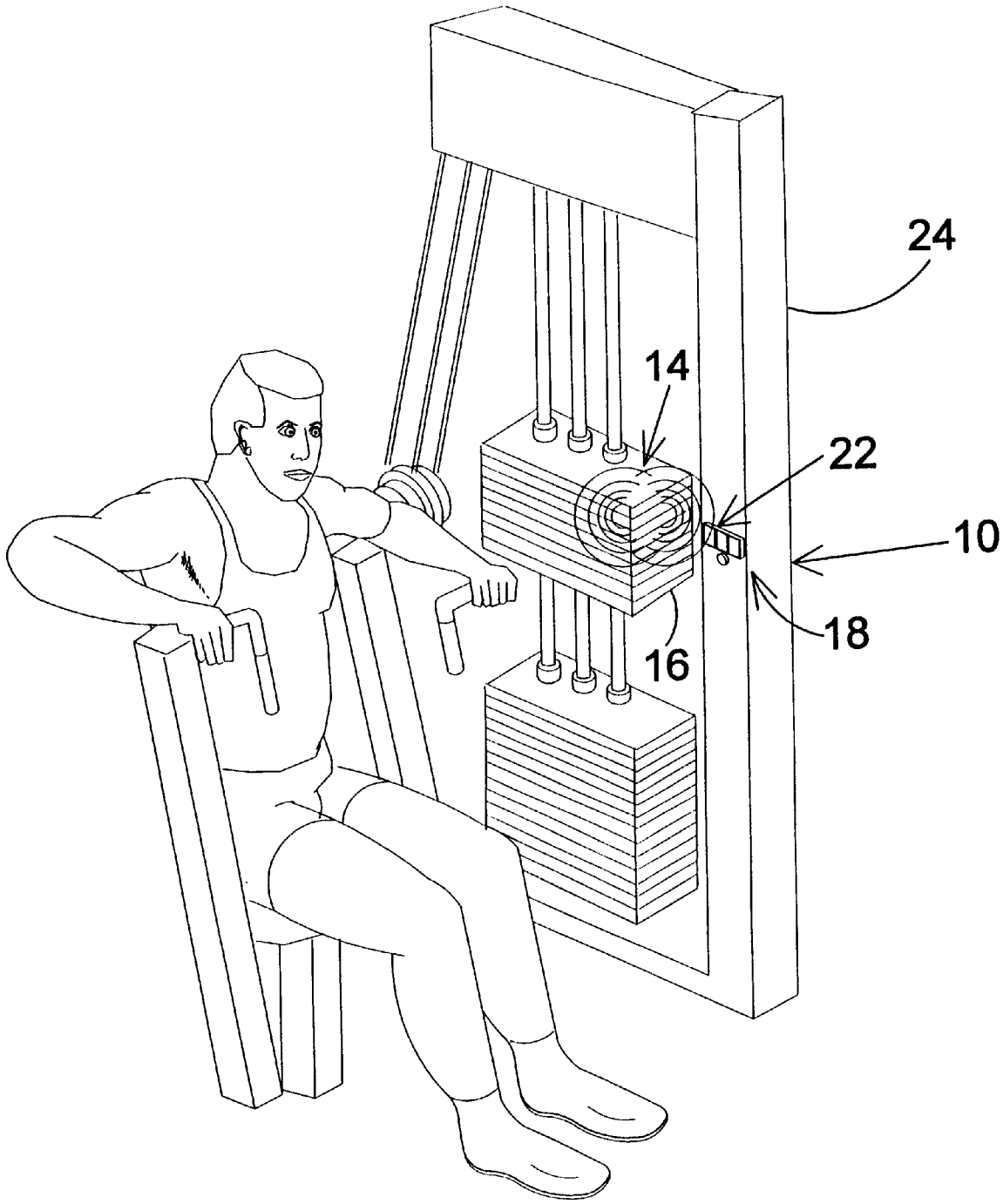

Turning to FIG. 1A, shown therein is a front elevation of another type of exercise equipment 24 wherein the present invention 10 is an integral component of the exercise machine. Shown is a permanent magnet 14 attached to the top of the weight stack 16. Also shown is a stationary magnetic sensor 18 contained within the proximate vertical member 24. The magnetic sensor 18 being effectively close to and having means for sensing changes to a magnetic field and having means for counting, recording and displaying 22 said changes caused by the passage of the permanent magnet 14 will incrementally increase a counter each time the permanent magnet 14 attached to the weight stack 16 completes one cycle.

Figure 2:
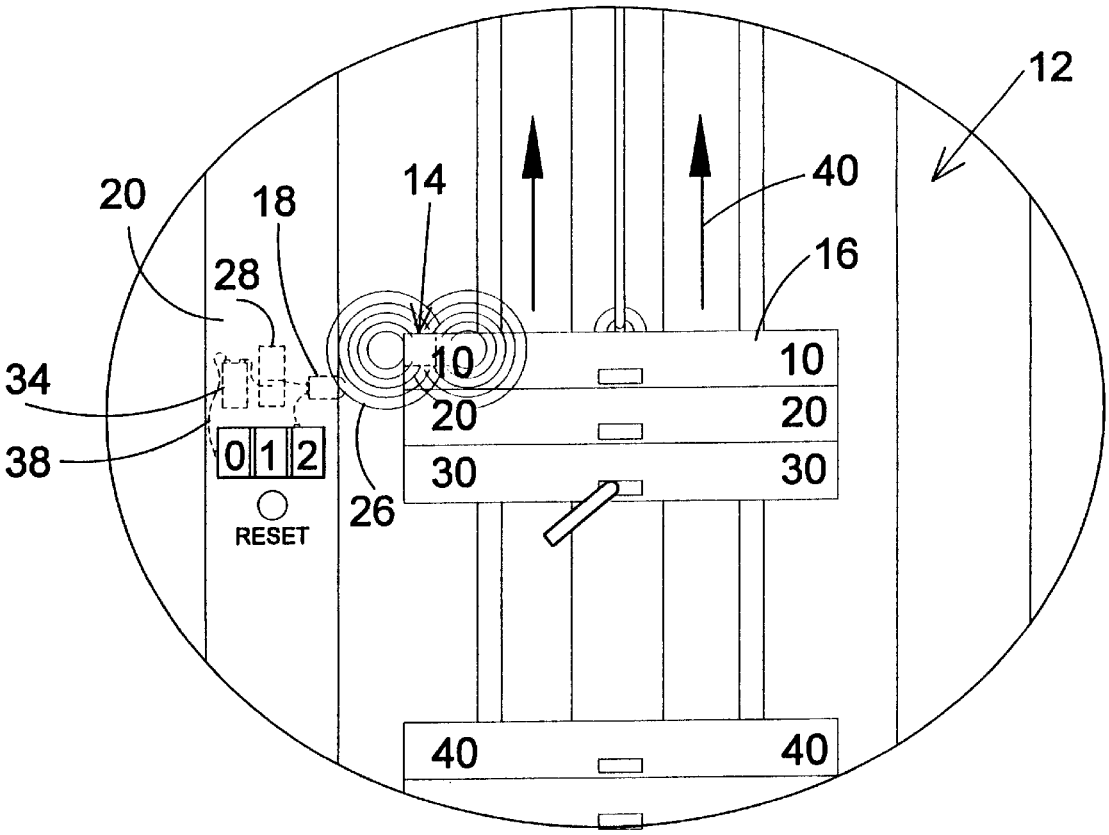

Turning to FIG. 2, shown therein is an enlarged view of the magnetic counter device of the present invention 10. Shown is a permanent magnet 14 contained within and forming an integral part of a member of the weight stack 16 and a static magnetic sensor member 18 which is located in the proximal vertical member 20 of the exercise machine 12. The magnetic sensor 18 having means 28 for detecting changes in magnetic flux 26 lines, generates a voltage which initiates the beginning of a cycle when the first permanent magnet 14 passes the magnetic sensor 18 a first time. Power supply 34 is also shown. Electrical connecting means 38, e.g., wires, are shown connecting the components of the present invention 10. Direction arrow 4 is also shown.

Figure 3:
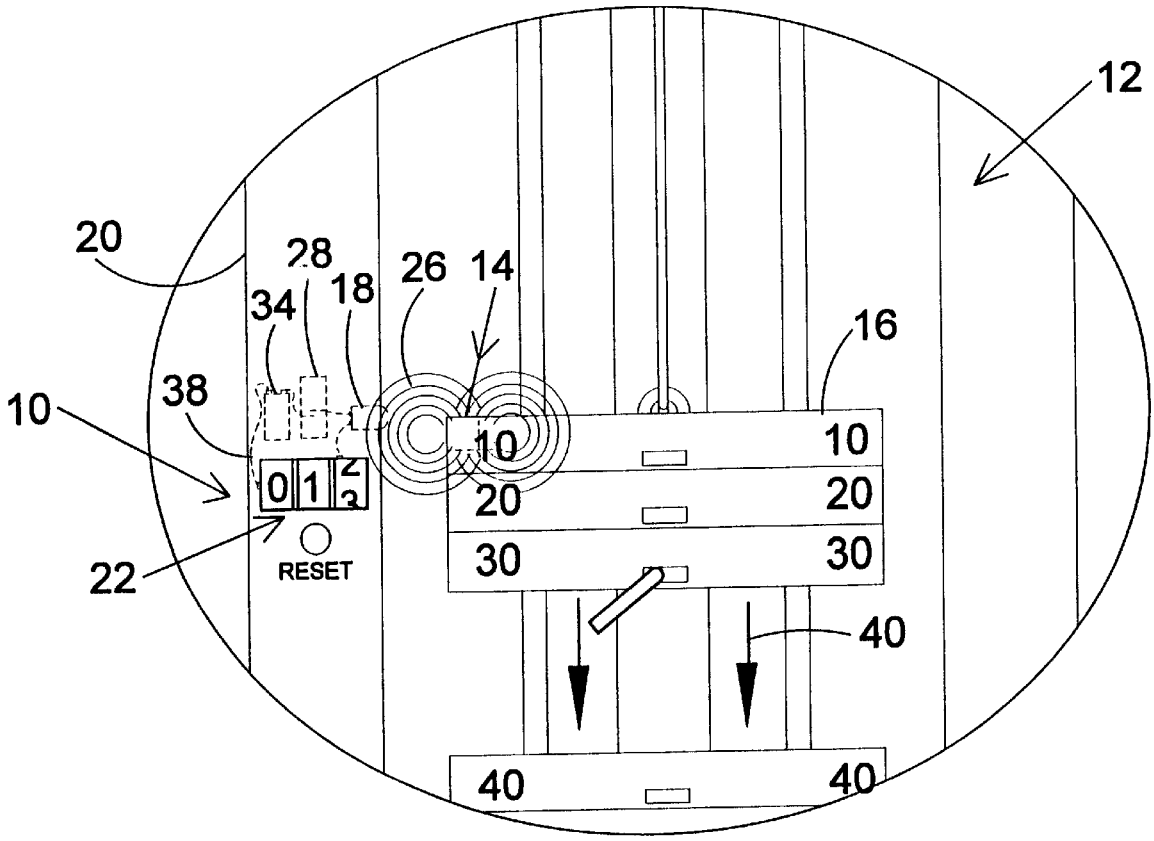

Turning to FIG. 3, shown therein is an enlarged view of the magnetic counter device of the present invention 10. Shown is a permanent magnet 14 contained within the weight stack 16 and a magnetic sensor member 18 which is located in the proximal vertical member 20 of the exercise machine 12. The magnetic sensor 18 having means 28 for detecting changes in magnetic flux 26 generates a voltage a second time thereby completing one cycle of the permanent magnet 14 whereupon said display member 22 will be incremented by one. Power supply 34 and electrical connecting means 38 are also shown. Direction arrow 40 is also shown.

Figure 4:
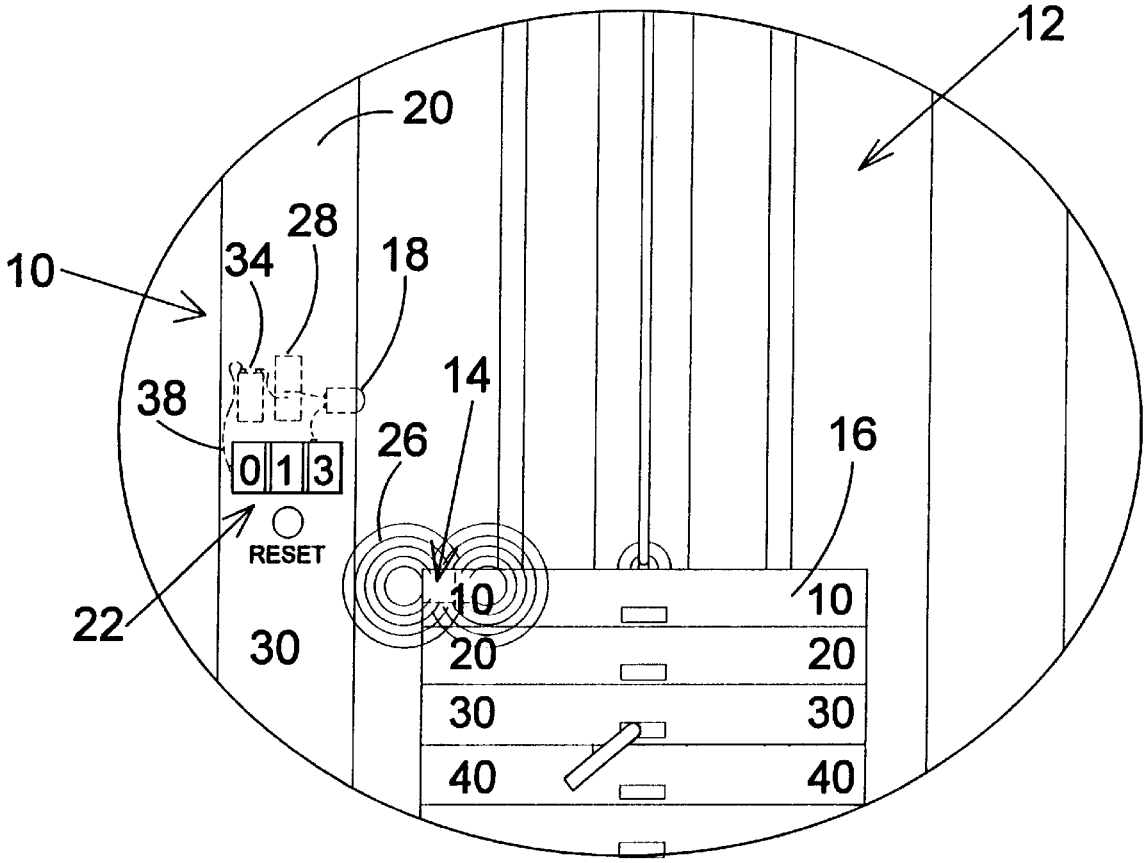

Turning to FIG. 4, shown therein is another enlarged view of the magnetic counter device of the present invention 10. Shown is a permanent magnet 14 contained within the weight stack 16 and a magnetic sensor member 18 which is located in the proximal vertical member 20 of the exercise machine 12. The magnetic sensor 18 having means 28 for detecting changes in magnetic flux 26 generates a voltage which is transmitted to a counter 22 which increments the display by one. Thereby completing one cycle. Also shown is a reset button 30 which can be selectively used to reset the counter to zero which button 30 would have appropriate electrical or mechanical connecting means to the reset button 30. Power supply 34 and electrical connecting means 38 are also shown.

Figure 5:
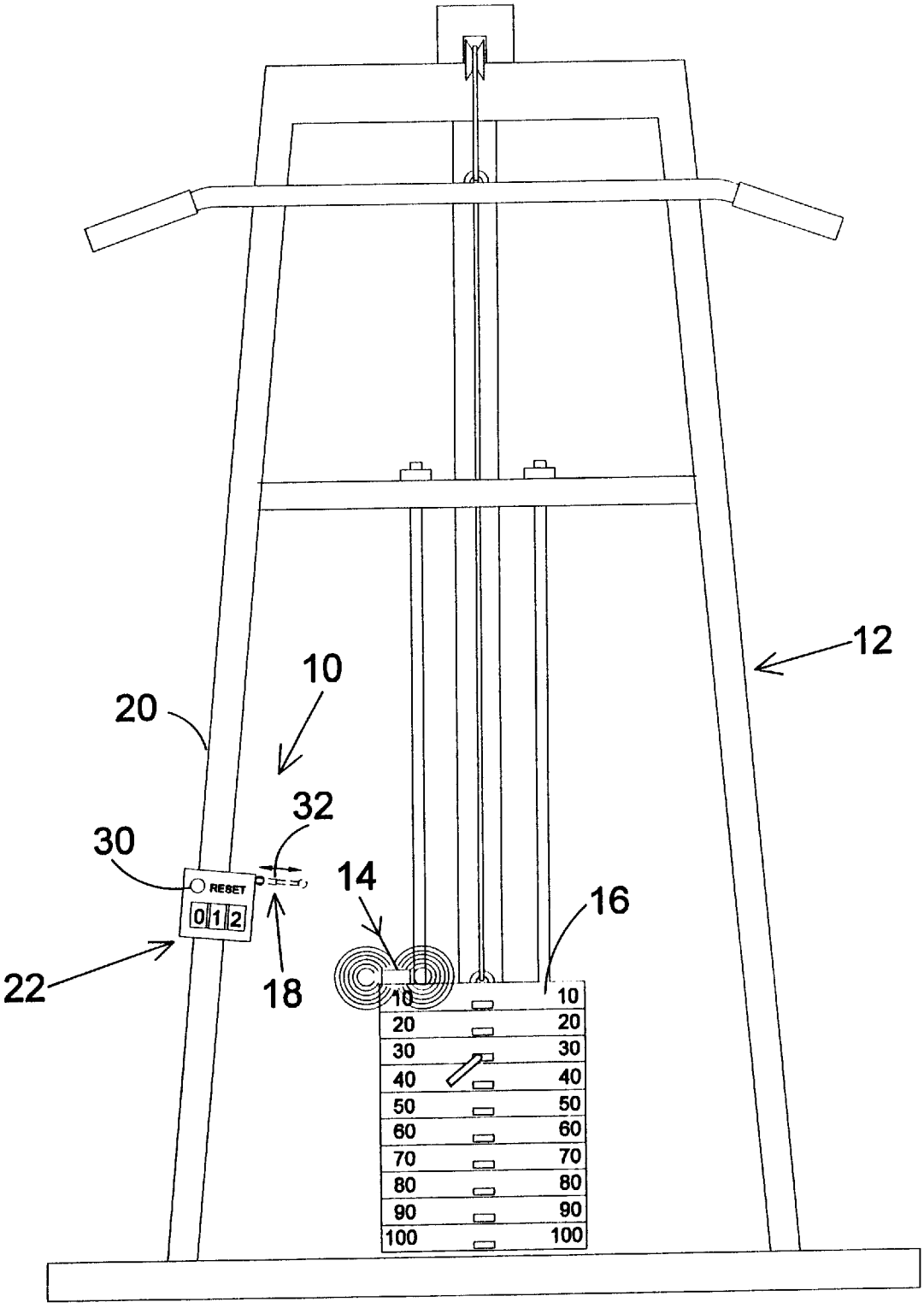

Turning to FIG. 5, shown therein is a front elevation of an alternate embodiment of the present invention 10. Shown is a magnetic counter having a permanent magnet 14 which is attached to the weight stack 16 and a magnetic sensor member 18 selectively attached to a proximate vertical member 20. The magnetic sensor 18 having means for sensing changes caused by the permanent magnet 14 will incrementally increase a counter each time the magnet 14 attached to the weight stack 16 completes one cycle. The magnetic sensor 18 is attached to an extendable retractable rod 32 which enables the additional embodiment to work over greater distances. Also shown is a reset button 30 for selectively resetting the display counter 22 to zero. The electrical components of this embodiment are similar to the previous embodiments disclosed.

Figure 6:
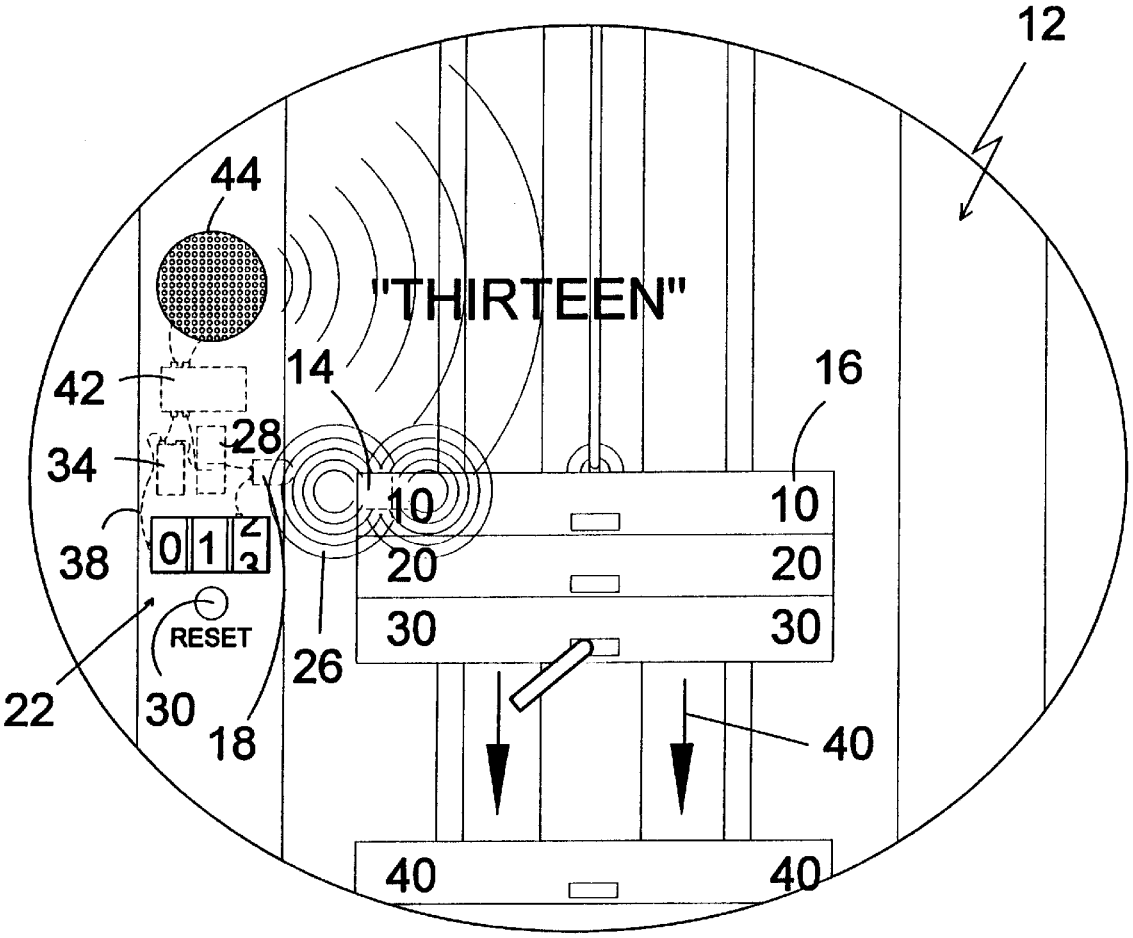
FIG. 6 is a view of the preferred embodiment of the present invention having circuitry incorporating a voice synthesizer which will also sound out the number of repetitions as the counter is incremented.

Turning to FIG. 6, shown therein is a view of the preferred embodiment of the present invention 10 having circuitry incorporating a voice synthesizer 42 and audio speaker 44 which will also sound out the number of repetitions as the counter 22 is incremented. Other components previously disclosed are also shown.

Figure 7:
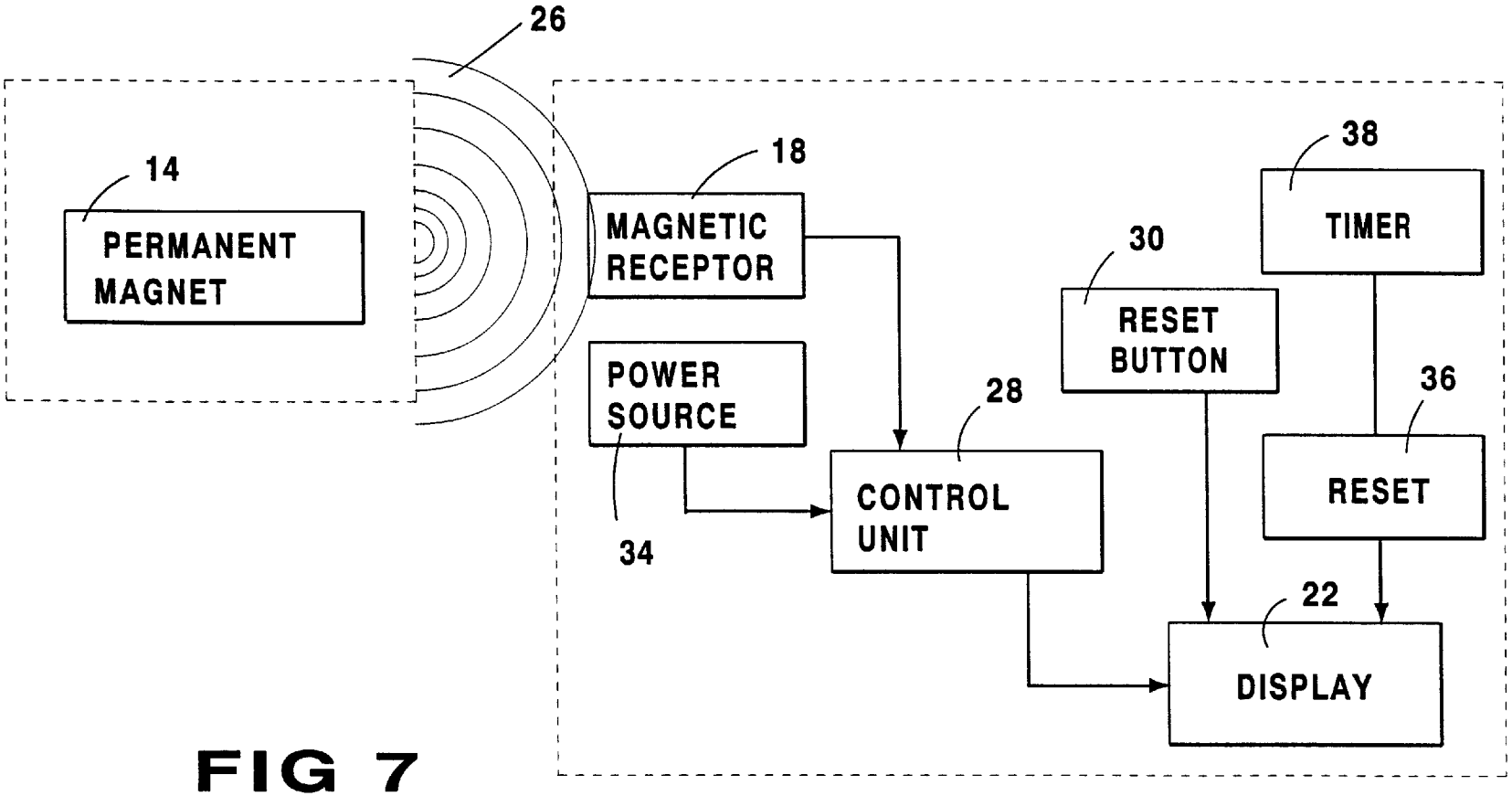
FIG. 7 is a diagrammatic view of the components of the preferred embodiment of the present invention.

Turning to FIG. 7, shown therein is a diagrammatic view of the components of the preferred embodiment of the present invention. Shown is a permanent magnet 14 with associated flux lines 26. A magnetic receptor 18 connects to a control unit 28 having a power supply 34. The display 22 has a manual reset button 30 and a second reset means 36 having a timer 38 which provides a reset at selectable timed intervals.

Figure 8:
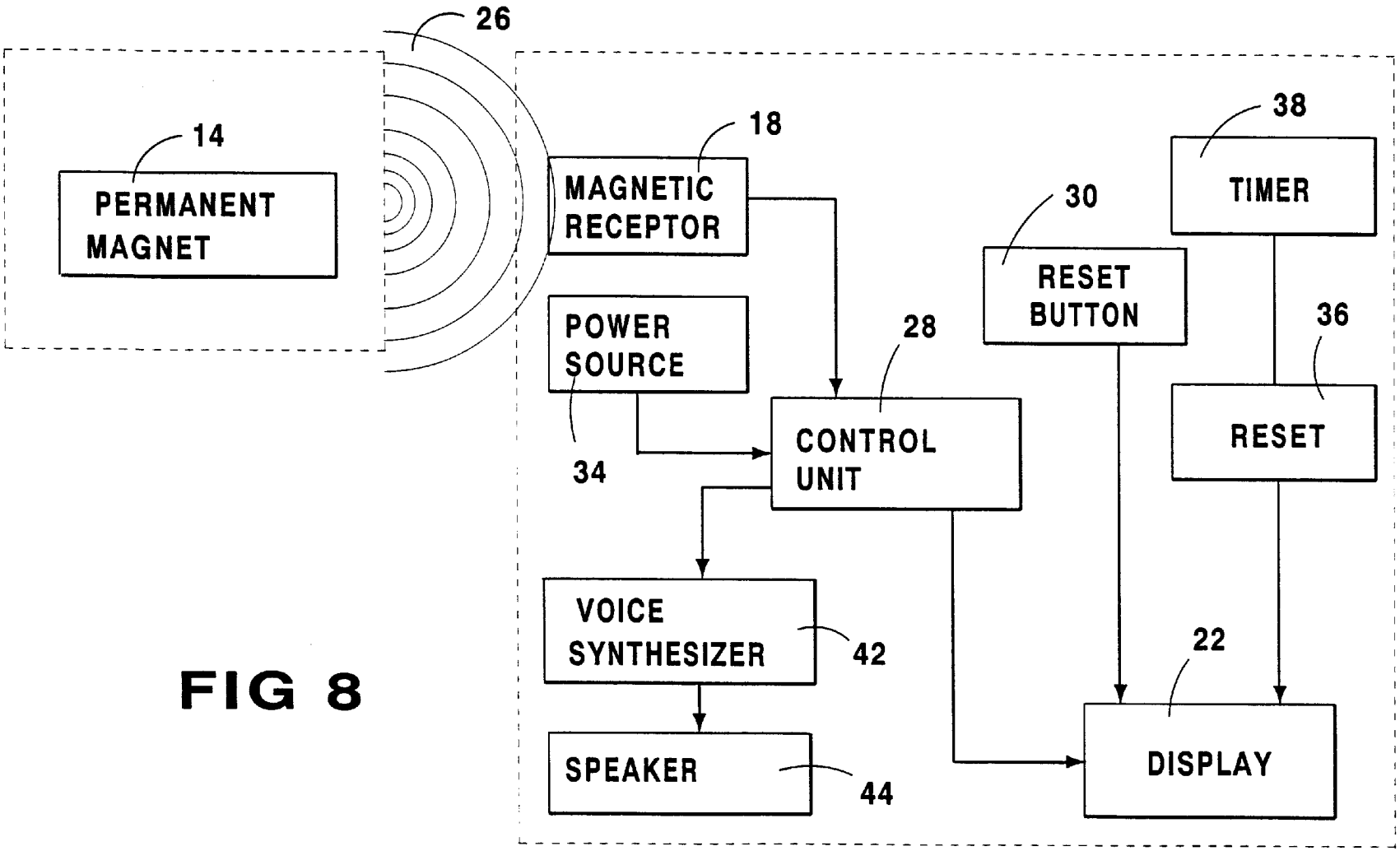
FIG. 8 is a diagrammatic view of the preferred embodiment of the present invention incorporating the voice synthesizer.

Turning to FIG. 8, shown therein is a diagrammatic view of the preferred embodiment of the present invention incorporating the voice synthesizer 42 and speaker 44. Shown is a permanent magnet 14 with associated flux lines 26. A magnetic receptor 18 connects to a control unit 28 having a power supply 34. The display 22 has a manual reset button 30 and a second reset means 36 having a timer 38 which provides a reset at selectable timed intervals.

I claim:

1. An apparatus for counting repetitions of an exercise machine, comprising:

a) a permanent magnet;

b) said permanent magnet being disposed on a movable member of the exercise machine;

c) a magnetic sensor;

d) said magnetic sensor being disposed on a non-movable member of the exercise machine;

e) said magnetic sensor effectively close to said permanent magnet to detect the magnetic field of said permanent magnet;

f) means for counting the number of times said permanent magnet passes said magnetic sensor;

g) means for displaying the number of times said permanent magnet passes said magnetic sensor;

h) a source of electrical energy to power the apparatus; and i) a telescoping rod upon which said magnetic sensor is disposed.

2. The apparatus of claim 1, said permanent magnet removably attached to a movable member of the exercise machine.

3. The apparatus of claim 1, said permanent magnet fixedly attached to a movable member of the exercise machine.

4. The apparatus of claim 1, said magnetic sensor, said means for counting, and said means for displaying removably attached to the exercise machine.

5. The apparatus of claim 1, said magnetic sensor, said means for counting and said means for displaying fixedly attached to the exercise machine.

6. The apparatus of claim 1, said magnetic sensor, said means for counting and said means for displaying mounted internal of the exercise machine.

7. The apparatus of claim 1, further comprising a means for an audible voice synthesizer whereby the number of repetitions will be announced.

8. The apparatus of claim 7, further comprising an audio speaker for announcing the number of repetitions of the exercise machine.

9. The apparatus of claim 1, said means for displaying further comprising a first means for resetting said means for displaying.

10. The apparatus of claim 9, wherein said first means for resetting said means for displaying further comprises mechanical means.

11. The apparatus of claim 9, wherein said first means for resetting said means for displaying further comprises electrical means.

12. The apparatus of claim 10, said means for displaying further comprising a second means for resetting said means for displaying.

13. The apparatus of claim 12, said second means for resetting further comprising a timer whereby said second means for resetting is reset at preselected intervals.

14. The apparatus of claim 2, wherein said exercise machine includes a weight stack and said permanent magnet is disposed on said weight stack.

* * * * *